US005526537A

United States Patent [19]

Conrad

[11] Patent Number: 5,526,537

[45] Date of Patent: Jun. 18, 1996

[54] PORTABLE CHAIR COMMODE

[76] Inventor: Lucas J. Conrad, 5240 Lukon La., Winston-Salem, N.C. 27104

[21] Appl. No.: 408,982

[22] Filed: Mar. 23, 1995

[51] Int. Cl.[6] ..... A47K 11/04

[52] U.S. Cl. ..... 4/483; 297/188.12

[58] Field of Search ..... 4/254, 479, 480, 4/483, 484; 297/188.08, 188.11, 188.12, 188.2

[56] References Cited

U.S. PATENT DOCUMENTS

| | | | |
|---|---|---|---|
| 1,246,791 | 11/1917 | Salati | 4/483 |
| 1,638,040 | 8/1927 | Killen | 4/480 |
| 2,745,112 | 5/1956 | Bindbeutel | 4/483 |
| 2,913,732 | 11/1959 | Jones | 297/188.12 X |
| 3,261,031 | 7/1966 | Gates | 4/480 X |
| 3,611,449 | 10/1971 | Berry | 4/134 |
| 3,795,923 | 3/1974 | Thomas | 4/134 |
| 3,829,908 | 8/1974 | Thomas | 4/1 |
| 3,854,773 | 12/1974 | Thomas | 297/417 |
| 4,550,455 | 11/1985 | Carson et al. | 4/483 X |
| 4,593,929 | 6/1986 | Williams | 4/484 X |
| 4,823,412 | 4/1989 | Spiegel | 4/483 |
| 4,888,833 | 12/1989 | Garcia et al. | 4/480 |
| 4,962,551 | 6/1990 | Bly | 4/480 |
| 5,123,126 | 6/1992 | Vincent | 4/480 |

*Primary Examiner*—Charles E. Phillips
*Attorney, Agent, or Firm*—Herbert J. Bluhm

[57] ABSTRACT

A portable chair commode for either male or female medical patients with limited mobility is disclosed which comprises a frame structure designed to support an open slot toilet seat. The underside surface of the toilet seat is provided with means for removably attaching a receptacle for collection of bowel and bladder discharge. The frame structure includes a pair of substantially vertical extensions connected to the rear legs for supporting a backrest and a pair of cantilevered armrests. A preferred embodiment has the cantilevered armrests pivotally mounted so that the armrests can be moved from a horizontal rest position to a substantially vertical position to improve ease of access to the open slot toilet seat. The preferred embodiment also includes means for adjusting the height of each leg and an adjustably mounted footrest associated with the front legs of the chair commode.

15 Claims, 4 Drawing Sheets

PORTABLE CHAIR COMMODE

FIELD OF THE INVENTION

This invention relates to a portable chair commode that is designed particularly for male or female medical patients who are experiencing restricted mobility and limited movement of their legs with respect to their torso.

BACKGROUND OF THE INVENTION

A number of portable commodes have been disclosed in the prior art which address various aspects of the design of such devices. However, none of the previously disclosed commodes appear to provide a satisfactory design that will accommodate the needs of a male medical patient with hip and/or leg trauma. Thus, the seats and associated excrement containers are not shaped and sized to facilitate simultaneous collection of both bowel discharge and bladder discharge and that is especially true when the user is unable to lean forward while seated on the portable commode (for example, patients recovering from hip surgery). Moreover, the armrests and related frame structures of prior art commode devices tend to restrict certain body movements of the user such as lateral movement of the legs. While a larger commode could alleviate some of these deficiencies, the increased size would restrict its portability and usefulness. This invention provides an improved portable chair commode design that addresses the above-noted deficiencies and is more versatile than previously described portable commodes.

SUMMARY OF THE INVENTION

In accordance with the invention disclosed herein, a portable chair commode is provided which includes a pair of front legs, a pair of rear legs and a pair of horizontal cross bars connecting the upper ends of the front legs with the rear legs to form opposing left and right leg assemblies. An additional horizontal cross bar connects the rear portions of the opposing leg assemblies and a pair of substantially vertical extensions connected to the rear legs rise a predetermined distance above the points at which the horizontal cross bars are connected to the rear legs. A pair of vertically disposed brace plates are secured to the upper ends of the front legs and extend toward each other in opposing fashion. Each brace plate has an upper horizontal support edge located at substantially the same elevation as the upper surfaces of the horizontal cross bars connecting the front and rear legs. A lower brace member disposed between and attached to the lower portions of the front legs provides stability and support for the brace plates.

An open slot toilet seat is adapted to engage the horizontal cross bars connecting the front and rear legs, the horizontal cross bar connecting the rear portions of the opposing leg assemblies and the upper edges of the brace plates secured to the upper ends of the front legs. Thus, the toilet seat is supported by those structural frame members while allowing a suitable excrement receptacle to be removably attached beneath the open slot toilet seat by retaining means associated with the toilet seat.

The present invention also includes a backrest disposed between and attached to the substantially vertical extensions connected to the rear legs as well as a pair of cantilevered armrests and associated mounting means secured to those vertical extensions. The cantilevered armrests are secured at positions that will provide sufficient vertical clearance between the armrests and the open slot toilet seat so that lateral movement of a user's legs will not be restricted.

Accordingly, it is a principal object of this invention to provide a portable chair commode that is more effective and easier to use than prior designs.

It is a further object of this invention to provide a portable chair commode with adjustable elements to accommodate the needs of users of different sex and stature.

It is still another object of this invention to provide a portable chair commode that is particularly suited to patients with limited movement of their hip joints, These objectives and other advantages of the invention will become apparent by carefully examining the following detailed description and the accompanying drawings,

Figure 1:
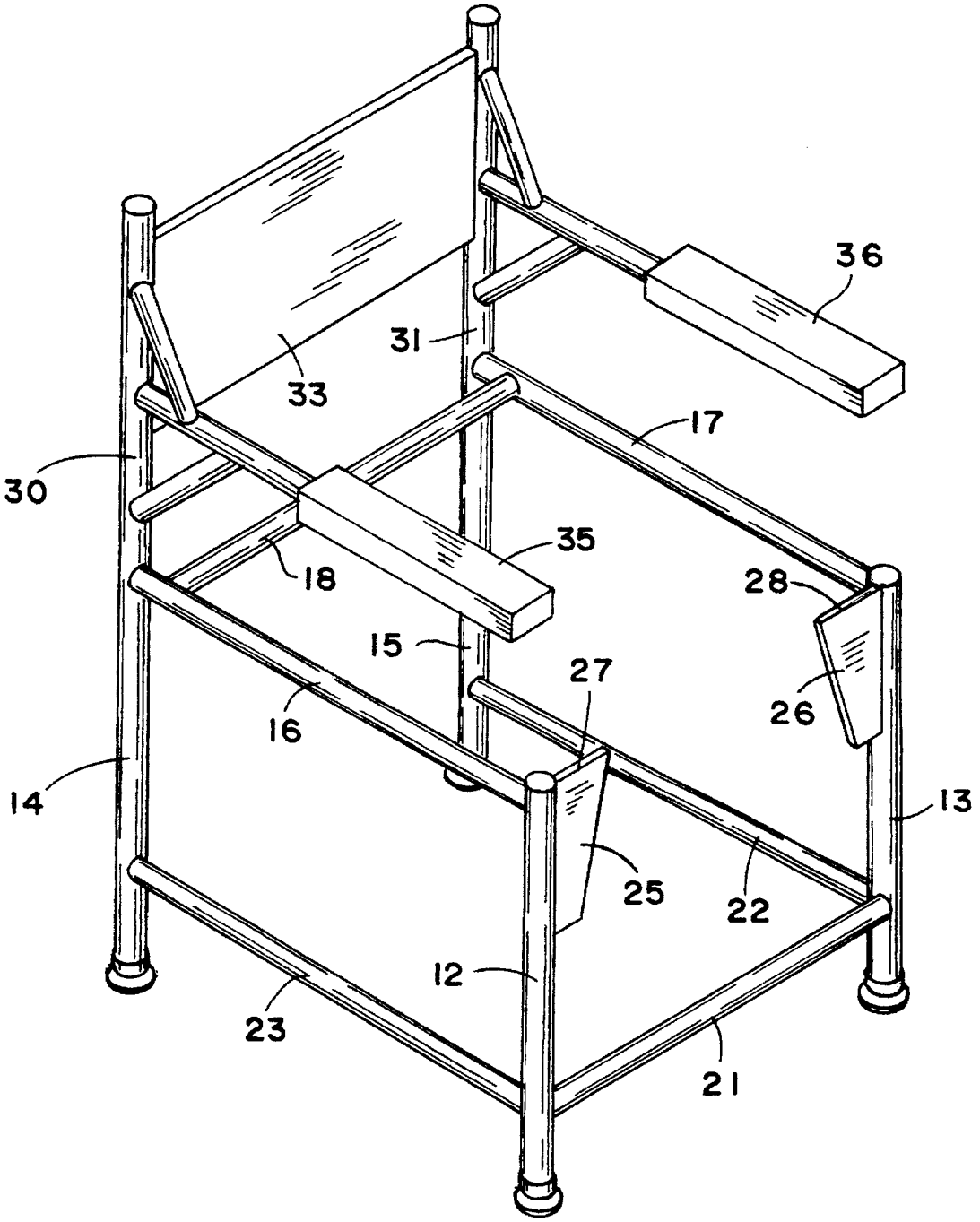
FIG. 1 is a perspective view of the frame structure of a portable chair commode in accordance with one embodiment of the present invention.

DESCRIPTION OF THE PREFERRED EMBODIMENTS in accordance with one embodiment of this invention, the frame structure of a portable chair commode is shown in FIG. 1. The frame structure includes a pair of front legs 12 and 13, a pair of rear legs 14 and 15 and a pair of horizontal cross bars 16 and 17 which connect the upper ends of the front legs, respectively, with the rear legs to form opposing leg assemblies. The rear portions of the opposing leg assemblies are connected by horizontally disposed cross bar 18. Although cross bar 18 could be connected directly to rear legs 14 and 15, it is preferred that it be connected to cross bars 16 and 17 to provide a more effective point of support for the toilet seat which will be described hereinafter.

Disposed between and attached to the lower portions of front legs 12 and 13 is front leg brace member 21. Optional side brace members 22 and 23 connect, respectively, the lower portions of the left front and rear legs and the right front and rear legs. Side brace members 22 and 23 may not be required if the leg assemblies are fabricated as a unitary structure or are otherwise provided with sufficient structural integrity under use conditions. Secured to the upper ends of front legs 12 and 13 are vertically disposed brace plates 25 and 26 which extend inwardly in opposing fashion to each other. Each of brace plates 25 and 26 has a horizontal support edge 27 and 28, respectively, that is located at a position that will provide partial support for a toilet seat placed on the frame structure.

Rear legs 14 and 15 are provided with substantially vertical extensions 30 and 31, respectively, which rise above the points at which cross bars 16 and 17 are connected to the rear legs. Backrest 33 is disposed between and attached to vertical extensions 30 and 31. Also attached to vertical extensions 30 and 31 are cantilevered armrests 35 and 36 which include appropriate mounting and/or bracing means to support the armrests in a cantilevered fashion. The armrests preferably include a padded section to cover any sharp corners or edges that might otherwise come into contact with a user of the chair commode.

Figure 2:
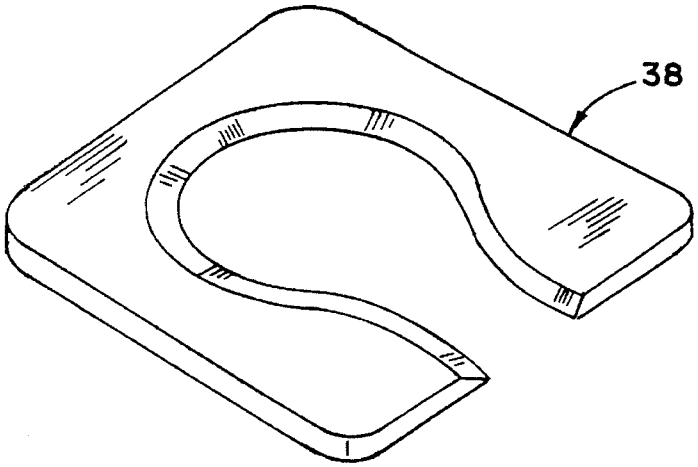
FIG. 2 is a perspective view of an open slot toilet seat designed for installation in the frame structure shown in FIG. 1.
Figure 3:
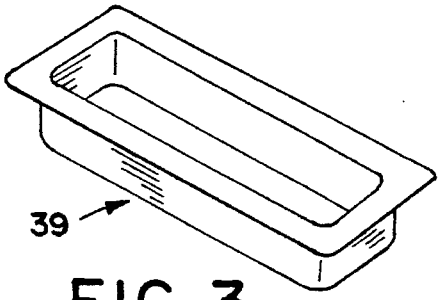
FIG. 3 is a perspective view of a receptacle designed for use with the frame structure of FIG. 1 and the toilet seat of FIG. 2.
Figure 4:
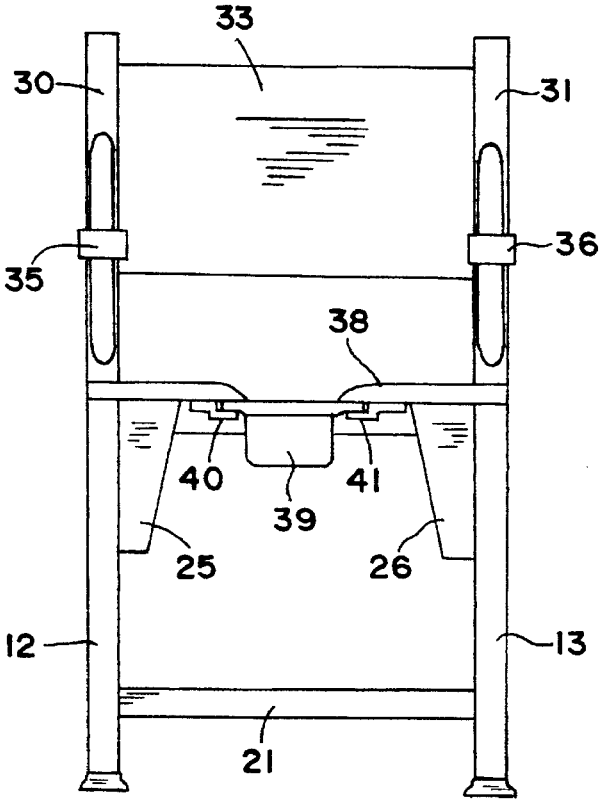
FIG. 4 is a front elevational view of the frame structure of FIG. 1 with the toilet seat of FIG. 2 and receptacle of FIG. 3 installed therein.

The portable chair commode of this invention is completed by installing an open slot toilet seat that is adapted to engage the horizontal cross bars 16, 17 and 18 as well as the upper edges 27 and 28 of brace plates 25 and 26. A suitable toilet seat is shown in FIG. 2 and it is attached to the frame structure by conventional fasteners such as screws, clamps, snap-on clips, etc. An elongated receptacle depicted in FIG. 3 is removably installed directly beneath the opening in the open slot toilet seat. The arrangement of the components of the chair commode is shown in FIG. 4 where open slot toilet seat 38 is supported by the frame structure. Receptacle 39 is, in turn, removably secured to the underside of toilet seat 38 by the flange associated with receptacle 39 and retaining clips 40 and 41 as well as an additional retaining clip (not shown) mounted on the rear underside portion of toilet seat 38. It is important that the depth of the open slot toilet seat, used in this invention be sufficiently great to accommodate patients who are either large in stature or who have limited movement, of the hip joint. It is preferred that the distance from the mouth of the slot opening to the termination of the opening at the rear portion of the seat be at least 40 centimeters but not greater than 65 centimeters. Conversely, the depth of the receptacle is not particularly critical and minimum depths of about 15 centimeters are suitable with maximum depths being limited to those that will permit installation and removal of the receptacle without interference with the frame structure of the chair commode.

Figure 5:
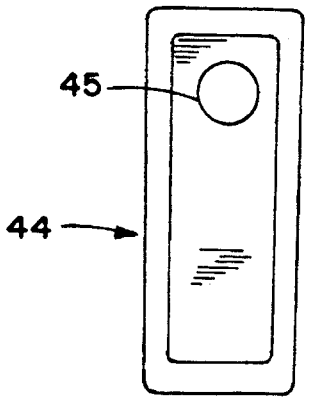
FIG. 5 is a plan view of an alternative receptacle that may be employed when the portable chair commode of the present invention is positioned above a conventional stationary commode.
Figure 6:
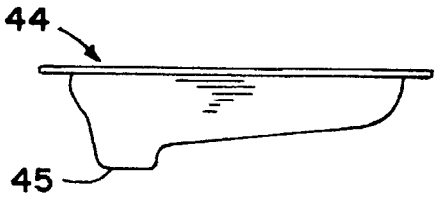
FIG. 6 is a side elevational view of the alternative receptacle shown in FIG. 5.

If desired, the portable chair commode of this invention may be used in conjunction with a conventional stationary commode by positioning the chair commode around the stationary commode in encircling fashion. Instead of using receptacle 39, a modified receptacle 44 depicted in FIGS. 5 and 6 is installed on the underside of toilet seal 38. Receptacle 44 is provided with an inclined bottom for directing solid and liquid waste through drain opening 45 and into the stationary commode below drain opening 45. Thus, receptacle 44 functions essentially as a funnel when the portable chair commode is used in this manner. If the design of the stationary commode permits the slot opening of toilet seat 38 to be brought into substantial alignment with the stationary commode, it may be possible to dispense with the use of modified receptacle 44 in such instances.

The materials from which the present portable chair commode is fabricated are conventional and well known the art. Metal tubing having either a round, square or rectangular cross-sectional configuration may be used for the frame structure. Since the open slot toilet seat is supported along its peripheral edge only, it should be formed from a relatively rigid material such as wood or suitable thermoplastic resins and should have sufficient thickness to withstand the weight of the user. The excrement receptacle may be fabricated from metal (stainless steel, for example) or appropriate thermoplastic resins and should be devoid of any square corners or crevices that would make cleaning of the receptacle difficult.

Figure 7:
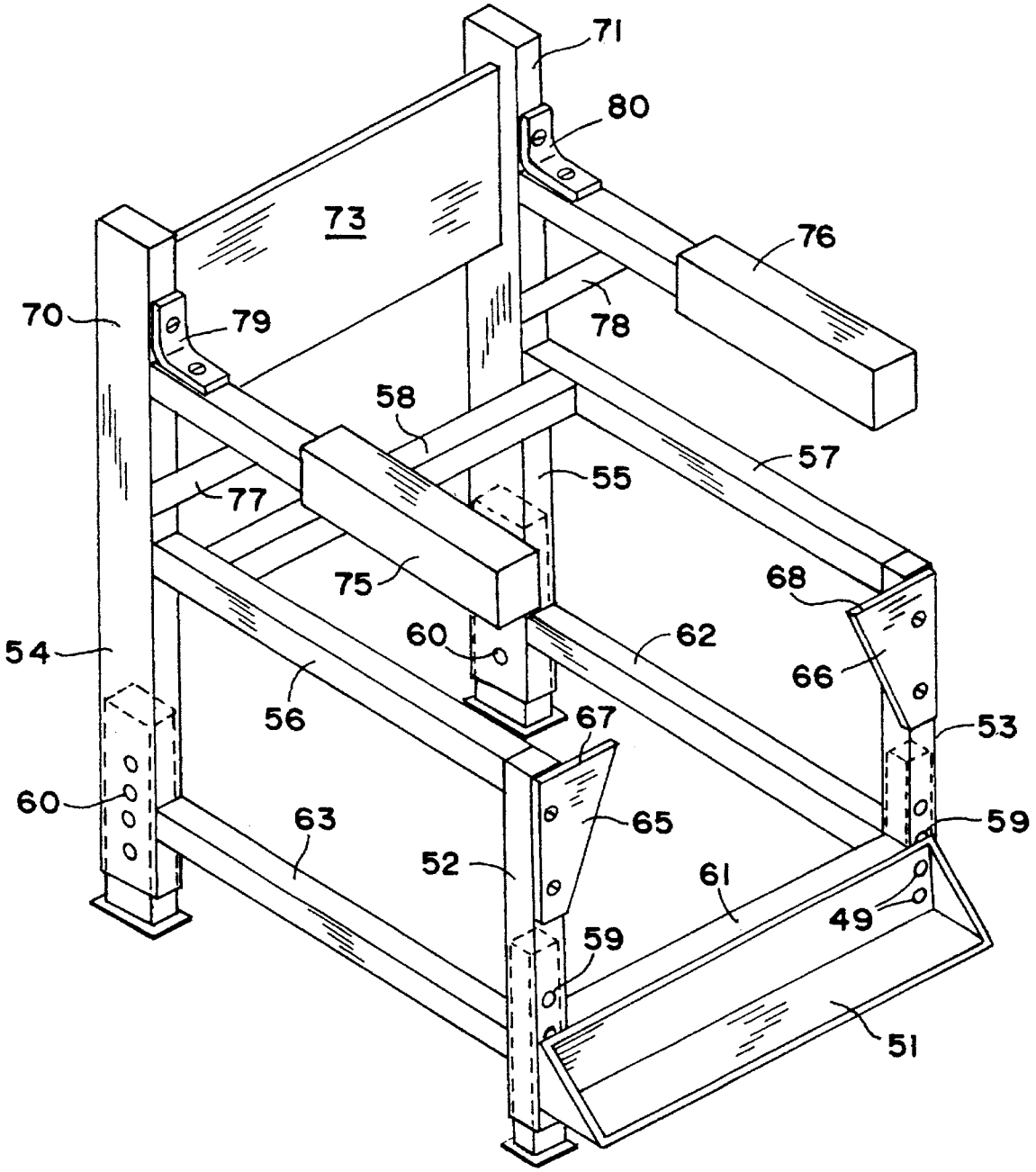
FIG. 7 is a perspective view of the frame structure of another embodiment of the present invention.

The frame structure for another embodiment of the present invention is shown in FIG. 7. Front legs 52 and 53 are fabricated from telescoping sections of square tubular metal provided with a plurality of cooperating, vertically spaced holes 59 for adjusting the relative positions of the telescoping sections and, therefore, the effective height of the front legs. Rear legs 54 and 55 are fabricated from telescoping sections of rectangular tubular metal provided with a plurality of cooperating, vertically spaced holes 60 for adjusting the effective height of the rear legs. The rectangular tubular metal imparts added strength to the frame structure and support for the backrest and armrests. Horizontal cross bars 56 and 57 connect the upper ends of the front legs with the respective rear legs to form opposing leg assemblies and the rear portions of the opposing leg assemblies are connected by horizontal cross bar 58. Optional side brace members 62 and 63 connect, respectively, the lower portions of the left front and rear legs and the right front and rear legs. Front leg brace member 61 connects the lower portions of front legs 52 and 53. Secured to the upper ends of front legs 52 and 53 by screws or other suitable fasteners are vertically disposed brace plates 65 and 66 which extend toward the front center of the chair commode frame structure in opposing fashion to each other. Brace plates 65 and 66 have horizontal support edges 67 and 68, respectively, which are positioned at substantially the same elevation as the upper surfaces of cross bars 56, 57 and 58.

Associated with front legs 52 and 53 is footrest 51 that is provided with means for attachment and vertical adjustment. As shown in FIG. 7, footrest 51 includes mounting holes 49 that are designed for alignment with vertically spaced holes 59 in each of the telescoping sections of front legs 52 and 53 by which height adjustment of the front legs may be accomplished. In a preferred arrangement, the inner telescoping sections of front legs 52 and 53 are provided with threaded nuts or sleeves affixed in registration with each of vertically spaced holes 59. Threaded bolts are inserted through holes 49 on each end of footrest 51 and the selected holes 59 of the outer telescoping sections of front legs 52 and 53 and into the threaded nuts or sleeves associated with the selected holes of the inner telescoping sections. When footrest 51 is adjustably installed on front legs 52 and 53 by bolts inserted into holes 59, footrest 51 serves essentially as a front leg brace and thereby obviates the need for front leg brace member 61. It is apparent that footrest 51 could also be adapted for attachment by suitable means to brace plates 65 and 66 which would permit the height of front legs 52 and 53 to be adjusted independently of the footrest adjustment.

Rear legs 54 and 55 are provided with substantially vertical extensions 70 and 71, respectively, which rise above the points at which cross bars 56 and 57 are connected to the rear legs. Backrest 73 is disposed between and attached to vertical extensions 70 and 71. Projecting forwardly from and attached to vertical extensions 70 and 71, respectively, are cantilevered armrests 75 and 76 which include angle braces 77 and 78 and corner braces 79 and 80 for contributing support to the cantilevered armrests. Armrests 75 and 76 are preferably provided with padding to cover any sharp corners or edges.

The frame structure shown in FIG. 7 is designed to support an open slot toilet seat such as the one shown in FIG. 2 together with receptacle 39 or 44 shown in FIGS. 3 and 5. If desired, additional support for the open slot toilet seat can be provided by angle braces installed between cross bar 58 and each of cross bars 56 and 57 and located at points where they provide the most support for the toilet seat without interfering with installation of receptacle 39 or 44. Similar bracing to support the front portion of the toilet seat may be installed between cross bar 56 and brace plate 65 as well as between cross bar 57 and brace plate 66. The assembled chair commode based on the FIG. 7 embodiment would have a front elevational view similar to that shown in FIG. 4. However, the FIG. 7 embodiment would be more versatile and sturdy than the FIG. 4 embodiment by virtue of the adjustable legs and the rectangularly-shaped rear legs and vertical extensions thereof. Also, the footrest provided by the FIG. 7 device improves user comfort, particularly in those instances where height of the chair commode legs is too great to allow the user's feet to rest on the floor supporting the chair commode.

Figure 8:
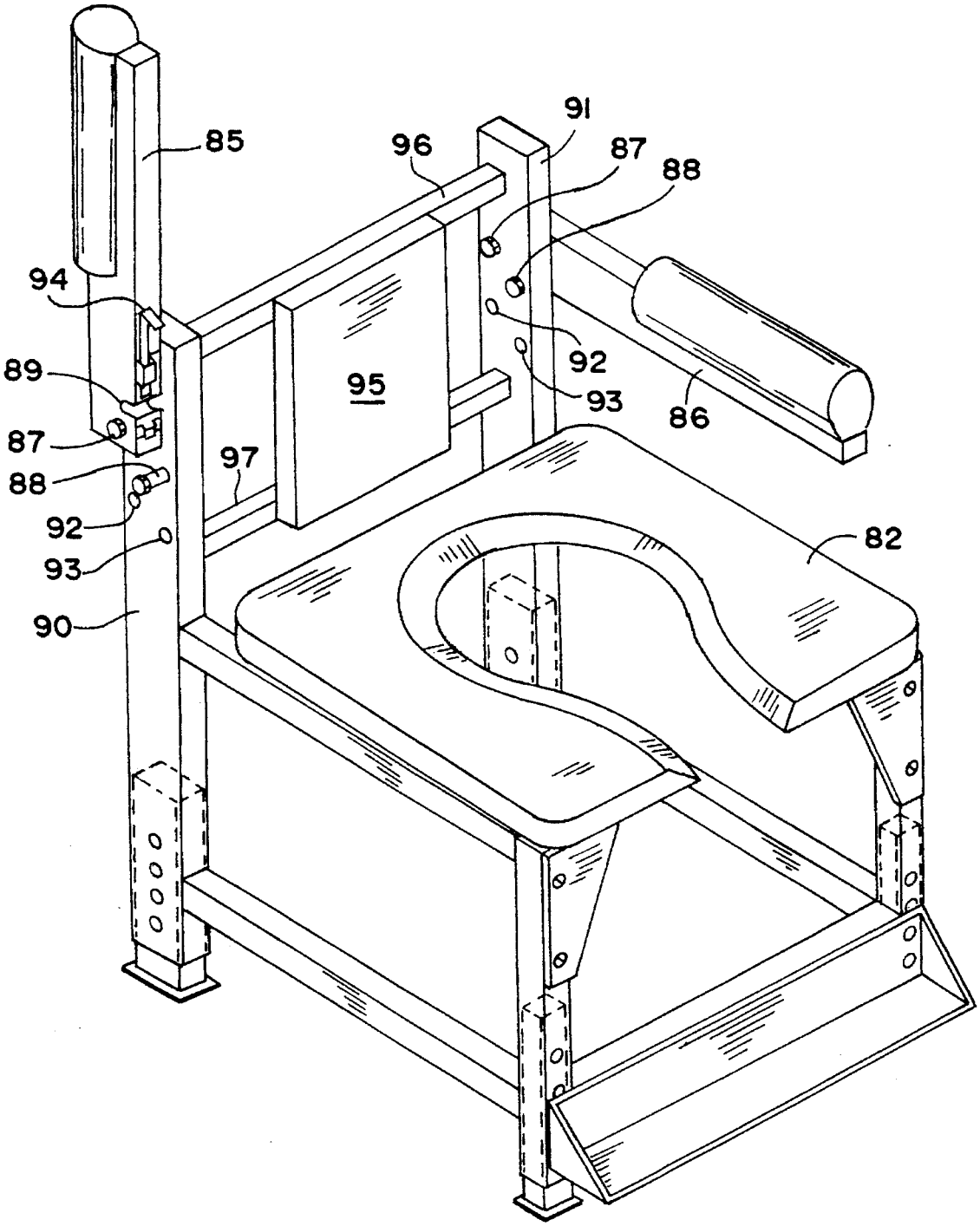
FIG. 8 is a perspective view of yet another embodiment of the present invention.

Depicted in FIG. 8 is yet another embodiment of the present invention which employs a frame structure that is essentially identical with that of the FIG. 7 embodiment. Accordingly, reference is made to the description of the FIG. 7 embodiment for an explanation of those elements which are common to both the FIG. 7 and FIG. 8 structures. It, will be noted that an open slot toilet seat 82 is shown installed in the FIG. 8 frame structure along with a backrest of modified design and a pair of cantilevered armrests which are different from those shown in the FIG. 7 device. The underside surface of toilet seat 82 is provided with retaining means for removably receiving excrement receptacles such as those shown in FIGS. 3, 5 and 6.

With regard to structural differences shown in the FIG. 8 embodiment, backrest 95 includes support members 96 and 97 which are horizontally disposed between and attached to vertical extensions 90 and 91. Cantilevered armrests 85 and 86 are fabricated from a suitable rigid material such as wood or tubular metal having a rectangular cross section. The armrests are rotatably attached to vertical extensions 90 and 91 by pivot bolts 87 which pass through holes in the attachment ends of armrests 85 and 86 and through holes in vertical extensions 90 and 91. Pivot bolts 87 are preferably provided with spacer sleeves or other suitable means for firmly securing the bolts to vertical extensions 90 and 91 while allowing free but snug rotation of the armrests. The armrests are preferably attached on the outboard sides of vertical extensions 90 and 91 to avoid interference with the backrest support members 96 and 97 when the armrests are rotated about pivot bolts 87. An armrest support bolt or pin 88 provided with a spacer sleeve is installed in vertical extension 90 and is designed to engage slot 89 formed in the underside edge of armrest 85. Bolt or pin 88 is located adjacent to the forward edge of vertical extension 90 at an elevation that, when fully engaged with slot 89, will support armrest 85 in a substantially horizontal position. Armrest 85 may be held in its substantially horizontal position by slide lock 94 associated with slot 89. Vertical extension 91 is similarly provided with a second bolt or pin 88 and spacer sleeve that engages a slot 89 (not shown) formed in the underside edge of armrest 86 to support armrest 86 in a horizontal position. Vertical extensions 90 and 91 are provided with one or more additional pairs of cooperating holes 92 and 93 which are designed to receive pivot bolt 87 and armrest support bolt or pin 88, respectively. Each pair of cooperating holes 92 and 93 is vertically spaced so that the functional horizontal position of armrests 85 and 86 can be selected to give the desired clearance between the upper surface of toilet seat 82 and the underside surface of armrests 85 and 86.

It will be appreciated that the chaff commode shown in FIG. 8 provides improved access to the toilet seat by raising one or both of the armrests. Also, the height adjustment means associated with the front and rear legs permits the open slot toilet seat to be adjusted to the desired height. For example, the chair commode can be positioned beside a bed with the toilet seat adjusted to the approximate level of the bed's mattress and with an armrest of the chair commode raised to a vertical position to facilitate moving a patient from the bed onto the chair commode. The chair commode of FIG. 8 also lends itself to use in conjunction with a conventional stationary commode by making appropriate height adjustments and employing a receptacle of the type shown in FIGS. 5 and 6, if necessary.

Various embodiments of this invention have been described above but it is apparent that other modifications could be made based on the teachings contained herein. Such modifications are deemed to be a part of this invention as defined by the scope of the appended claims.

What is claimed is:

1. A portable chair commode comprising a frame structure that includes a) a pair of front legs, b) a pair of rear legs, c) a pair of horizontal cross bars connecting the upper ends of the front legs, respectively, with the rear legs to form opposing leg assemblies, d) a horizontal cross bar connecting the rear portions of the opposing leg assemblies, e) a pair of substantially vertical extensions connected to the rear legs which extend upwardly from the points of attachment for said pair of horizontal cross bars, f) a pair of vertically disposed brace plates secured to the upper ends of the front legs and extending inwardly in opposing fashion to each other, said brace plates having an upper horizontal support edge located at substantially the same elevation as the upper surfaces of said pair of horizontal cross bars, g) a lower brace member disposed between axed attached to the lower portions of said pair of front legs, said portable chair commode further comprising a backrest disposed between and attached to said pair of substantially vertical extensions, a pair of cantilevered armrests and associated mounting means secured to said pair of substantially vertical extensions, an open slot toilet seat adapted to engage the horizontal cross bars connecting the front and rear legs and the rear portions of the opposing leg assemblies as well as the upper horizontal support edges of the brace plates secured to the front legs with the slot opening of the toilet seat being located adjacent to said brace plates, a receptacle positioned beneath the open slot toilet seat and retaining means associated with the underside surface of the toilet seat for removably securing said receptacle in its position beneath the open slot toilet seat.

2. The portable chair commode of claim 1 wherein the front and rear legs are provided with means for adjusting the height of each leg.

3. The portable chair commode of claim 2 wherein said means for adjusting the height of each leg comprises two telescopically joined sections with each section having a plurality of cooperating, vertically spaced holes designed to receive removable fasteners for maintaining the telescopically joined sections in a selected height position.

4. The portable chair commode of claim 3 wherein said pair of substantially vertical extensions connected to the rear legs and said cantilevered armrests and associated mounting means include means for vertically varying the mounting position of each cantilevered armrest.

5. The portable chair commode of claim 4 which additionally includes a footrest secured to the lower portions of the front legs that is provided with vertical adjustment means for mounting the footrest at a selected position.

6. The portable chair commode of claim 4 wherein the means for adjusting the height of each leg is capable of elevating the open slot toilet seat to a level that will permit the portable chair commode to be placed in encircling fashion to a conventional stationary commode having an opening for receiving excrement and the receptacle beneath the open slot toilet seat is provided with a drain opening the lower portion thereof that can be positioned in alignment with the opening of the conventional stationary commode.

7. A portable chair commode comprising a) a pair of front legs and a pair of rear legs provided with means for adjusting the height of each leg, b) a pair of horizontal cross bars connecting the upper ends of the front legs, respectively, with the rear legs to form opposing leg assemblies, c) a horizontal cross bar connecting the rear portions of the opposing leg assemblies, d) a pair of substantially vertical extensions connected to the rear legs and extending upwardly from the points of attachment for said pair of horizontal cross bars to the rear legs, e) a pair of vertically disposed brace plates secured to the upper ends of the front legs which extend inwardly in opposing fashion to each other and which present an upper horizontal support edge, f) a lower brace member disposed between and attached to the lower portions of said pair of front legs, g) a backrest disposed between and attached to said pair of substantially vertical extensions, h) a pair of movable cantilevered armrests and associated mounting means secured to said pair of substantially vertical extensions, i) an open slot toilet seat adapted to engage the horizontal cross bars connecting the front and rear legs and the rear portions of the opposing leg assemblies as well as the upper horizontal support edges of the brace plates secured to the front legs with the slot opening of the toilet seat being located adjacent to said brace plates, and j) a receptacle positioned beneath the open slot toilet seat and retaining means associated with the underside surface of the toilet seat for removably securing said receptacle in its position beneath the open slot toilet seat.

8. The portable chair commode of claim 7 wherein said means for adjusting the height of each leg comprises two telescopically joined sections with each section having a plurality of cooperating, vertically spaced holes designed to receive a removable fastener for maintaining the two telescopically joined sections in a selected height position.

9. The portable chair commode of claim 8 wherein said lower brace member disposed between and attached to the lower portions of said pair of front legs comprises a footrest provided with holes designed to cooperate with said vertically spaced holes in the telescopically joined front leg sections and the removable fasteners for simultaneously maintaining the telescopically joined front leg sections and the footrest in selected height positions.

10. The portable chair commode of claim 8 which additionally includes a footrest associated with the front legs and vertical adjustment means for securing the footrest at a selected height position.

11. The portable chair commode of claim 9 wherein each of said pair of movable cantilevered armrests and associated mounting means includes a fastener designed to secure the cantilevered armrest to the substantially vertical extension in pivoting fashion that allows the cantilevered armrest to be moved from a horizontal rest position to a substantially vertical position.

12. The portable chair commode of claim 11 wherein each of said pair of movable cantilevered armrests and associated mounting means includes lock means for retaining the cantilevered armrest in a horizontal rest position.

13. The portable chair commode of claim 11 wherein each of said pair of substantially vertical extensions connected to the rear legs is provided with a plurality of vertically spaced holes for vertically varying the mounting position of said movable cantilevered armrest.

14. The portable chair commode of claim 13 wherein said receptacle positioned beneath the open slot toilet seat is provided with a drain opening in the lower portion thereof to permit the portable chair commode to be used in conjunction with a conventional stationary commode.

15. The portable chair commode of claim 13 wherein the distance from the mouth of the slot opening to the termination of the slot opening at the rear portion of the open slot toilet seat is at least 40 centimeters.

* * * * *